US011174749B2

(12) United States Patent
Le Biez

(10) Patent No.: US 11,174,749 B2
(45) Date of Patent: Nov. 16, 2021

(54) ABRADABLE COATING HAVING VARIABLE DENSITIES

(71) Applicant: SAFRAN AIRCRAFT ENGINES, Paris (FR)

(72) Inventor: Philippe Charles Alain Le Biez, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/062,249

(22) PCT Filed: Dec. 13, 2016

(86) PCT No.: PCT/FR2016/053360
§ 371 (c)(1),
(2) Date: Jun. 14, 2018

(87) PCT Pub. No.: WO2017/103422
PCT Pub. Date: Jun. 22, 2017

(65) Prior Publication Data

US 2018/0371932 A1 Dec. 27, 2018

(30) Foreign Application Priority Data

Dec. 14, 2015 (FR) ..... 1562324

(51) Int. Cl.
*B22F 5/00* (2006.01)
*F01D 11/12* (2006.01)
(Continued)

(52) U.S. Cl.
CPC ..... *F01D 11/122* (2013.01); *B22F 3/105* (2013.01); *B22F 5/009* (2013.01); *B22F 7/02* (2013.01);
(Continued)

(58) Field of Classification Search
CPC .. B22F 3/105; B22F 5/009; B22F 7/02; F01D 11/122
See application file for complete search history.

(56) References Cited

U.S. PATENT DOCUMENTS 4,914,794 A 4/1990 Strangman
5,236,151 A 8/1993 Hagle et al.
(Continued)

FOREIGN PATENT DOCUMENTS

CN 1427085 A 7/2003
CN 103375193 A 10/2013
(Continued)

OTHER PUBLICATIONS

Office Action dated Nov. 27, 2019, in corresponding Chinese Patent Application No. 2016800732609 (16 pages).
(Continued)

*Primary Examiner* — Nathan H Empie
(74) *Attorney, Agent, or Firm* — Bookoff McAndrews, PLLC

(57) ABSTRACT

A method of fabricating an abradable coating of varying density, and an abradable coating of varying density. The method comprises the following steps: providing a substrate having a first portion and a second portion; depositing a first precursor material on the first portion of the substrate; compressing the first precursor material between the substrate and a first bearing surface; sintering the first precursor material as compressed in this way in order to obtain a first abradable coating portion on the first portion of the substrate, and possessing a first density; depositing a second precursor material on the second portion of the substrate; and compressing the second precursor material between the substrate and a second bearing surface.

14 Claims, 4 Drawing Sheets

(51) Int. Cl.

| | |
|---|---|
| ***B22F 3/105*** | (2006.01) |
| ***C23C 24/08*** | (2006.01) |
| ***B22F 7/06*** | (2006.01) |
| ***B22F 7/02*** | (2006.01) |

(52) U.S. Cl.

CPC ..... *B22F 7/06* (2013.01); *C23C 24/08* (2013.01); *F01D 11/12* (2013.01); *B22F 2998/10* (2013.01); *F05B 2230/90* (2013.01); *F05D 2230/22* (2013.01); *F05D 2230/30* (2013.01); *F05D 2300/514* (2013.01); *F05D 2300/522* (2013.01); *F05D 2300/609* (2013.01)

(56) References Cited

U.S. PATENT DOCUMENTS

| | | | | |
|---|---|---|---|---|
| 10,870,152 | B2 * | 12/2020 | Le Biez | B22F 3/105 |
| 2009/0136345 | A1 * | 5/2009 | Tholen | F01D 11/125 415/230 |
| 2009/0297331 | A1 * | 12/2009 | Caucheteux | F01D 11/122 415/1 |
| 2011/0103940 | A1 * | 5/2011 | Duval | F01D 5/284 415/173.4 |
| 2012/0107103 | A1 * | 5/2012 | Kojima | F01D 11/122 415/173.4 |
| 2013/0177740 | A1 * | 7/2013 | Merrill | B22F 5/009 428/158 |
| 2013/0344347 | A1 | 12/2013 | Hugot et al. | |
| 2014/0263579 | A1 | 9/2014 | Kulkarni et al. | |
| 2015/0240651 | A1 * | 8/2015 | Tham | F01D 11/122 415/1 |
| 2015/0266093 | A1 | 9/2015 | Ferrer | |
| 2015/0337672 | A1 * | 11/2015 | McCaffrey | F01D 11/08 415/173.1 |
| 2015/0354392 | A1 | 12/2015 | Lipkin et al. | |
| 2016/0236995 | A1 * | 8/2016 | Lai | C04B 41/91 |
| 2018/0361480 | A1 * | 12/2018 | Le Biez | B22F 7/06 |

FOREIGN PATENT DOCUMENTS

| | | | |
|---|---|---|---|
| CN | 103827352 | A | 5/2014 |
| CN | 103874580 | A | 6/2014 |
| CN | 104451519 | A | 3/2015 |
| EP | 2317079 | A2 | 5/2011 |
| EP | 3081764 | A1 | 10/2016 |
| FR | 2996475 | | 4/2014 |
| GB | 1361814 | | 7/1974 |
| JP | 2009/256759 | A | 11/2009 |
| RU | 2320776 | C2 | 3/2008 |
| SU | 997111 | A1 | 2/1983 |
| WO | WO 2014/053754 | A1 | 4/2014 |
| WO | WO 2017/103420 | A1 | 6/2017 |

OTHER PUBLICATIONS

International Search Report and Written Opinion with English translation dated Apr. 6, 2017, in International Application No. PCT/FR2016/053360 (13 pages).

International Search Report and Written Opinion with English translation dated Apr. 6, 2017, in International Application No. PCT/FR2016/053358 (11 pages).

Office Action dated Mar. 2, 2020, in Russian Patent Application No. 2018125846 (12 pages).

Official Communication dated Jun. 3, 2020, in EP Application No. 16825487.8 (6 pages).

* cited by examiner

ABRADABLE COATING HAVING VARIABLE DENSITIES

CROSS-REFERENCE TO RELATED APPLICATIONS

This application is the U.S. national phase entry under 35 U.S.C. § 371 of International Application No. PCT/FR2016/053360, filed on Dec. 13, 2016, which claims priority to French Patent Application No. 1562324, filed on Dec. 14, 2015, the entireties of each of which are herein incorporated by reference.

FIELD OF THE INVENTION

The present disclosure relates to a method of fabricating an abradable coating of varying density, and also to such an abradable coating of varying density.

Such an abradable coating may be used in particular for fitting to a ring of a rotary machine so as to provide the machine with sealing at the tips of rotating blades, for example. Such an abradable coating is particularly adapted for fitting to turbine rings in the field of aviation, and most particularly in airplane turbojets.

STATE OF THE PRIOR ART

In numerous rotary machines, it is now the practice to provide the stator ring with abradable tracks facing the tips of blades of the rotor. Such tracks are made using so-called "abradable" materials that, on coming into contact with the rotating blades, wear more easily than the blades. This ensures minimal clearance between the rotor and the stator, thereby improving the performance of the rotary machine, without running the risk of damaging the blades in the event of them rubbing against the stator. On the contrary, such rubbing abrades the abradable tracks, thereby automatically matching the diameter of the stator ring very closely to the rotor. Such abradable tracks are thus often put into place in the compressors of turbine engines.

In contrast, they are used much more rarely in the turbines of such machines, particularly in high pressure turbines, where physico-chemical conditions are extreme.

Specifically, the burnt gas from the combustion chamber penetrates into the high pressure turbine at temperature and pressure levels that are very high, thereby leading to premature erosion of conventional abradable tracks.

Under such circumstances, in order to protect the turbine ring, it is often preferred to provide it with a thermal barrier type coating of materials that serve to protect the ring against erosion and corrosion while presenting density that is too great for the coating to be effectively abradable.

Nevertheless, it can naturally be understood that under such circumstances, the integrity of the blades is no longer ensured in the event of contact with the stator, which means that it is necessary to provide greater clearance between the rotor and the stator, thereby increasing the rate of leakage past the tips of the blades and thus reducing the performance of the turbine.

There therefore exists a real need for a method of fabricating an abradable coating and for such an abradable coating that avoid the drawbacks inherent to the above-mentioned known configurations, at least in part.

SUMMARY OF THE INVENTION

The present disclosure provides a fabrication method for fabricating an abradable coating of varying density, the method comprising the following steps: providing a substrate having a first portion and a second portion; depositing a first precursor material on the first portion of the substrate; compressing the first precursor material between the substrate and a first bearing surface; sintering the first precursor material as compressed in this way in order to obtain a first abradable coating portion on the first portion of the substrate, and possessing a first density; depositing a second precursor material on the second portion of the substrate; compressing the second precursor material between the substrate and a second bearing surface; and sintering the second precursor material as compressed in this way in order to obtain a second abradable coating portion on the second portion of the substrate, and possessing a second density distinct from the first.

This method makes it possible to obtain a coating of varying density. Specifically, various parameters can be adjusted differently for each portion of the substrate so as to obtain abradable coating portions that present different properties. Firstly, it is possible to select different precursor materials. In particular, the size of the particles making up the precursor material or the initial porosity of the precursor material serve to influence the final porosity of the abradable coating, and thus its density.

It is also possible to deposit a greater or smaller quantity of precursor material prior to the compression step, i.e. to deposit a layer of precursor material of greater or lesser thickness. This quantity of material thus has an influence on the final density of the abradable coating.

It is also possible to compress the precursor materials more or less strongly during the compression step so as to compact these materials to a greater or lesser extent prior to sintering: this reduces their porosity to a greater or lesser extent, thereby influencing the final porosity and thus the final density of each portion of the abradable coating.

It is also possible to act on the temperatures and/or the durations of the sintering steps in order to have an influence on the microstructure of the abradable coating, and in particular on its final porosity and on its density.

In the present disclosure, the term "porosity" is used to designate the ratio of the volume of interstitial spaces between the grains of the material in question divided by the overall volume of said material. In addition, in the present disclosure, it should be understood that the first and second portions of the substrate, like the first and second portions of the abradable coating, are of significant size in order to be able to perform the functions for which they are intended. Thus, as can be seen in the figures, each portion of the substrate, and thus each portion of the abradable coating possesses a width that is greater than 2 millimeters (mm), preferably greater than 5 mm, and thus a length that is greater still.

Under such circumstances, by means of this method, it is possible to adjust locally the porosity, and thus the density, of the coating in order to satisfy requirements or constraints that differ locally. For example, it is possible to provide those zones of the coating that are sensitive to erosion with density that is high, and to provide those zones of the coating that are to come into contact with a moving body with density that is lower, thereby reinforcing the easily abradable nature of such zones. In addition, it is possible to arrange the first coating portion, i.e. the portion of greater density, in such a manner as to mask and thus protect the second coating portion, which is of density that is lower.

In certain implementations, the steps of depositing, compressing, and sintering the second precursor material take place after the steps of depositing, compressing, and sintering the first precursor material. By separating these steps in this way, it is possible to individualize the deposition, compression, and sintering parameters for each coating portion, thus making it easy to obtain different properties for each portion of the abradable coating.

In certain implementations, the steps of compressing and sintering the first precursor material are performed within a first mold; the steps of compressing and sintering the second precursor material are performed within a second mold; and the second mold is distinct from the first mold.

In certain implementations, the first and second molds are a single mold.

In certain implementations, the first mold includes the first bearing surface together with at least one protection wall provided so as to lie beside the first precursor material at the interface between the first and second portions of the substrate during the steps of compressing and sintering the first precursor material. This protection wall serves to prevent pieces of the first precursor material from moving and becoming attached on the second portion of the substrate.

In certain implementations, the second mold includes a movable portion extending facing the second portion of the substrate and including the second bearing surface, and a stationary portion extending facing, preferably against, the first portion of the substrate. This stationary portion serves to protect the already-finished first abradable coating portion. Thus, and preferably, only the mold portion that faces the second portion of the substrate is movable.

In certain implementations, the steps of depositing the first and second precursor materials take place simultaneously or in succession, the steps of compressing the first and second precursor materials take place simultaneously, and the step of sintering the first and second precursor materials take place simultaneously. This serves to reduce the total time required for performing the method. It is also possible to use only one mold. Under such circumstances and by way of example, the difference in final density can be obtained by using precursor materials that are different, thicknesses of precursor material layers that are different, or indeed different amounts of compression. By way of example, such differing compression may be obtained using a mold possessing bearing surfaces lying at different levels, or using a mold that possesses a plurality of movable portions that are independent.

In certain implementations, the first portion of the substrate is situated at a first level, and the second portion of the substrate is situated at a second level different from the first level. By means of this level difference between the first and second portions of the substrate, the reduction in volume that is available during the compression step is greater when the substrate is close to the bearing surface in the initial state: for example, assuming that the second level is deeper than the first level, the portion of the precursor material situated over the first portion of the substrate is thus compressed to a greater extent than the portion of the precursor material situated over the second portion of the substrate. Higher pressure thus exists in this portion of the precursor material, thereby leading to greater density for the material after sintering. Conversely, in the second portion of the precursor material, since the compression is smaller, the reduction in the porosity of the material and thus its densification are smaller.

In certain implementations, the second portion of the substrate is obtained by machining at least one groove in a blank for the substrate. Such a two-level substrate is thus easy to fabricate since it suffices to fabricate a blank that is regular and then machine a groove in the blank solely at the desired locations.

In certain implementations, the first portion of the substrate is obtained by adding at least one low wall on a blank for the substrate. This method is particularly suitable for repairing an existing part of thickness that is not sufficient for machining a groove.

In certain implementations, the low wall is fabricated directly on the blank for the substrate by sintering, in particular by a sintering method of the spark plasma sintering (SPS) type.

In certain implementations, the low wall is fabricated independently and is fitted on by welding or brazing. In particular, it may be fitted on by a tungsten inert gas (TIG) type welding method.

In certain implementations, the first and second bearing surfaces are continuous, one extending the other. It should be understood that the bearing surfaces do not have any discontinuity such as a step or any other sudden change of level within them or at their interface.

In certain implementations, the bearing surfaces are rectilinear, at least in a direction extending transversely to the first and second portions of the substrate. There thus exists a section plane passing both through the first portion and the second portion of the substrate and in which the bearing surfaces are rectilinear.

In certain implementations, at least one bearing surface, and preferably each bearing surface, is in the form of a sector of a cylinder, preferably a sector of a circular cylinder.

In certain implementations, at least one bearing surface, and preferably each bearing surface, is a surface of a shaping mold.

In certain implementations, the first portion of the abradable coating possesses final porosity of less than 15%, preferably less than 5%. The first portion of the coating thus possesses porosity that is sufficiently low, and thus density that is sufficiently high, to withstand erosion.

In certain implementations, the second portion of the abradable coating possesses final porosity greater than 20%, preferably greater than 30%. The second portion of the coating thus possesses porosity that is sufficiently high, and thus density that is sufficiently low, to present easily-abradable behavior.

In certain implementations, the first portion of the abradable coating is subjected to densification by at least 80%, and preferably by least 100% during the compression and sintering steps. In the present disclosure, the term "densification" is used to mean the increase in the density of the material making up the abradable coating between its initial step when the precursor material is deposited and its final step obtained after the compression and sintering steps. In other words, it is the difference between the final density and the initial density divided by the initial density.

In certain implementations, the second portion of the abradable coating is subjected to densification of at most 70%, preferably at most 50%, and more preferably at most 10% during the compression and sintering step.

In certain implementations, prior to the step of depositing the precursor material on one of the portions of the substrate, preferably on the second portion of the substrate, the method further comprises a step of forming a backing layer by sintering on the portion under consideration of the substrate, the backing layer having porosity of less than 15%, and preferably less than 5%. This backing layer serves to conserve a highly densified layer under the second portion of the abradable coating, which second portion is densified little.

Thus, the substrate remains protected in the event of the body traveling past the coating being subjected to a radial offset that is greater than the maximum expected offset. This serves in particular to protect the substrate in the event of a large unbalance in the moving body, for example.

In certain implementations, this step of forming a backing layer by sintering is performed in the second mold or in a mold that is identical to the second mold.

In certain implementations, after the step of sintering one of the precursor materials, the method further comprises a step of forming a surface layer by sintering on at least one of the portions of the abradable coating, preferably on its second portion, the surface layer having final porosity of less than 15%, and preferably less than 5%. This layer makes it possible to ensure that the coating has little surface roughness. It may also be formed on the entire surface of the abradable coating.

In certain implementations, the step of forming a surface layer by sintering is performed in the second mold or in a mold identical to the second mold.

In certain implementations, the thickness of the surface layer lies in the range 0.05 mm to 0.10 mm.

In certain implementations, at least one precursor material, preferably each precursor material, is a powder of metal or of ceramic.

In certain implementations, the first and second precursor materials are different. In other implementations, they are identical.

In certain implementations, the first precursor material is a powder of grain size less than 20 micrometers (μm).

In certain implementations, the second precursor material is a powder of grain size greater than 45 μm.

In certain implementations, the second precursor material is a powder of grain size less than 100 μm.

In certain implementations, the substrate is a ring sector. In particular, it may be a turbine ring sector for mounting on the stator of the turbine.

In certain implementations, the first portion of the substrate extends along the second portion of the substrate.

In certain implementations, the substrate possesses a longitudinal channel extending between two longitudinal shoulders, the shoulders forming part of the first portion of the substrate and the bottom of the channel forming part of the second portion of the substrate. At the end of the method, this leads to a strip of low density, i.e. that is easily abradable, in the zone that is likely to make contact, e.g. with the blades of a rotor, and two strips of coating that are of greater density on either side of the abradable strip, serving to protect the abradable strip from erosion, e.g. as caused by the axial flow of a stream of air.

The present disclosure also provides an abradable track of varying density, comprising a first portion including sintered material possessing a first density, and a second portion, contiguous with the first portion, including a sintered material possessing a second density distinct from the first density. As explained above, this makes it possible to protect the zones that are more sensitive to erosion, while providing a layer that is easily abradable in the zones that are to come into contact with the moving body.

In certain embodiments, the thickness of the first portion of the abradable track is less than the thickness of the second portion.

In certain embodiments, the materials of the first and second portions of the abradable track are different. In other embodiments, they are identical.

In certain embodiments, the abradable track is obtained using a fabrication method according to any one of the above implementations.

The present disclosure also provides a turbine or compressor ring including an abradable track according to any one of the above embodiments.

The present disclosure also provides a turbine engine including an abradable track or a turbine or compressor ring according to any of the above embodiments.

The above characteristics and advantages, and others, appear on reading the following detailed description of examples of the proposed device and method. The detailed description refers to the accompanying drawings.

BRIEF DESCRIPTION OF THE DRAWINGS

The accompanying drawings are diagrammatic and seek above all to illustrate the principles of the invention.

In the drawings, from one figure to another, elements (or portions of an element) that are identical are identified by the same reference signs. In addition, elements (or portions of an element) belonging to different examples but having functions that are analogous are identified in the figures by numerical references incremented by 100, 200, etc.

DETAILED DESCRIPTION OF EXAMPLE(S)

In order to make the invention more concrete, examples of methods and abradable tracks are described below in detail with reference to the accompanying drawings. It should be recalled that the invention is not limited to these examples.

Figure 1:
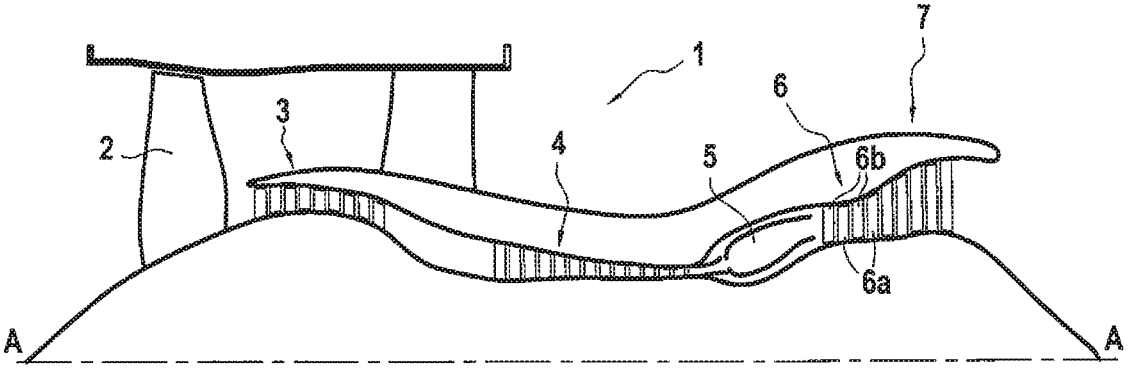
FIG. 1 is a section view of a turbine engine of the invention.

FIG. 1 is a section view of a bypass turbojet 1 of the invention, the section being on a vertical plane containing the main axis A of the turbojet. Going from upstream to downstream in the air stream flow direction, the turbojet comprises: a fan 2; a low pressure compressor 3; a high pressure compressor 4; a combustion chamber 5; a high pressure turbine 6; and a low pressure turbine 7.

Figure 2:
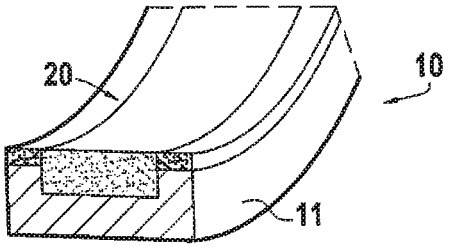
FIG. 2 is a fragmentary perspective view of an example of a stator ring of the invention.

The high pressure turbine 6 has a plurality of blades 6*a* rotating with the rotor and a plurality of guide vanes 6*b* mounted on the stator. The stator of the turbine 6 comprises a plurality of stator rings 10 arranged facing the movable blades 6*a* of the turbine 6. As can be seen in FIG. 2, each stator ring 10 is subdivided into a plurality of sectors 11, each provided with an abradable track 20 against which the movable blades 6*a* rub in the event of a radial excursion of the rotor.

Figure 3A:
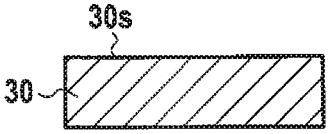
FIGS. 3A to 3G show various successive steps in an example method of the invention.

An example of such an abradable track 20 is described with reference to FIGS. 3A to 3G. In FIG. 3A, a blank 30 is initially provided. Specifically, it comprises a ring sector obtained using a conventional method. Its surface 30*s* is regular, rectilinear in the axial section plane of FIG. 3A, and circularly arcuate in a radial section plane.

Figure 3B:
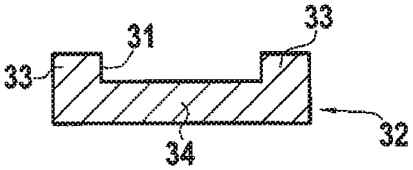

As shown in FIG. 3B, a groove 31 is then machined longitudinally, i.e. circumferentially, in the surface of the blank 30 so as to form a channel: this produces a substrate 32 possessing two shoulders 33 on either side of the groove 31, respectively upstream and downstream. In the present description, the groove 31 possesses a depth of 5 mm. Nevertheless, making such a groove is optional: other examples of the method may specifically be applied to a substrate that is regular without presenting any difference in level.

Together the two shoulders form a first substrate portion 33; the portion of the substrate 32 that is situated at the bottom of the groove 31 forms a second substrate portion 34.

Figure 3C:
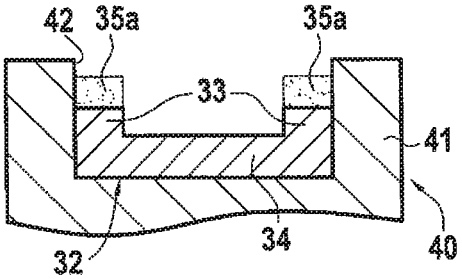

As shown in FIG. 3C, the substrate 32 as formed in this way is subsequently placed in a cavity 42 of a first shaping mold 40. This first shaping mold 40 comprises a main portion 41 including the cavity 42 of axial dimensions that correspond to the dimensions of the substrate 32, and a cover portion 43 (visible in FIG. 3D).

A first precursor material 35*a*, specifically a metal powder, is then placed on the shoulders 33, i.e. on the first portion of the substrate 32, while leaving the groove 31 and thus the second portion 34 of the substrate free from powder. On this occasion, a removable masking block may be arranged in the groove 31 in order to prevent the powder of the first precursor material 35*a* from becoming deposited on the second portion 34.

The powder 35*a* then forms a continuous layer of constant thickness over the shoulders 33 of the substrate 32. In the present example, the powder is an alumina powder of grain size centered around 5 μm; this layer possesses a thickness of 10 mm and has initial porosity of about 30%.

Figure 3D:
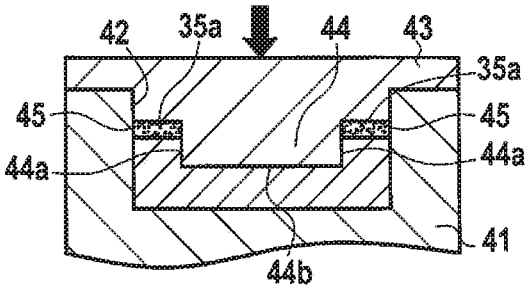

As shown in FIG. 3D, the mold 40 is then closed by putting its cover portion 43 on its main portion 41. The cover portion 43 has a central protection block 44 and two bearing surfaces 45 extending on either side of the protection block 44.

These bearing surfaces 45, which are rectilinear in the axial plane of FIG. 3D and circularly arcuate in a radial plane, then bear against the top surface of each layer of powder of the first precursor material 35*a*. The protection block 44 becomes inserted between the layers of powder 35*a* and penetrates into the grove 31 so as to close it: the layers of powder of the first precursor material 35*a* are thus enclosed in the space defined by the first portion 33 of the substrate, by the walls of the cavity 42 of the main portion 41 of the mold 40, by the bearing surface 45 of the cover 43 of the mold 40, and by the side walls 44*a* of the protection block 44 of the cover 41 of the mold 40.

Stress is then exerted on the cover 43 of the mold 40 so as to bear against the layers of powder 35*a* and compress them between the substrate 32 and the bearing surfaces 45 of the cover 43 of the mold 40. The layer of powder 35*a* is thus compressed until its thickness is reduced to 2 mm. In this example, the front surface 44*b* of the protection block 44 of the cover 43 of the mold 40 then bears against the second portion 34 of the substrate.

During this compression step, the particles of powder of the first precursor material 35*a* are compacted against one another, thereby filling in some of the voids initially present between the particles, with the air that is expelled in this way being discharged from the mold 40. The porosity of the powder therefore decreases during this compression step, and the density of the powder increases.

Once such a compressed state has been obtained, the layer of powder 35*a* as compressed in this way is sintered using a conventional method so as to obtain a first portion 36*a* of coating 36 overlying the first portion 33 of the substrate 32 and possessing a thickness of 2 mm and porosity of 6%.

The substrate 32 is then transferred into a second shaping mold 50 having a main portion 51 with a cavity 52 of axial dimensions corresponding to the dimensions of the substrate 32, and a cover portion 53 (visible in FIG. 3F) having two stationary portions 54, i.e. portions that do not move, and a movable portion 55.

Figure 3E:
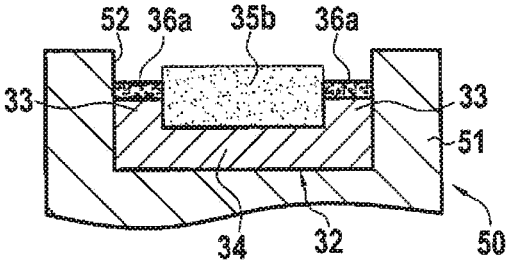

As shown in FIG. 3E, a second precursor material 35*b*, specifically a metal powder, is then deposited in the groove 31, i.e. on the second portion 34 of the substrate 32, while leaving the first coating portion 36*a* free from powder. On this occasion, removable masking blocks may be placed on these coating portions 36*a* so as to avoid the powder of the second precursor material 35*b* from being deposited thereon.

The powder 35*b* then forms a continuous layer of constant thickness over the second portion 34 of the substrate 32. In the present example, the powder is an alumna powder having a grain size centered around 100 μm; this layer possesses a thickness of 12 mm and initial porosity of about 70%.

On this occasion, it should be observed that it is possible to obtain initial porosity that is greater by adding a pore-generating agent to the powder, which agent is eliminated subsequently while performing the method, e.g. during a step of pyrolysis.

Figure 3F:
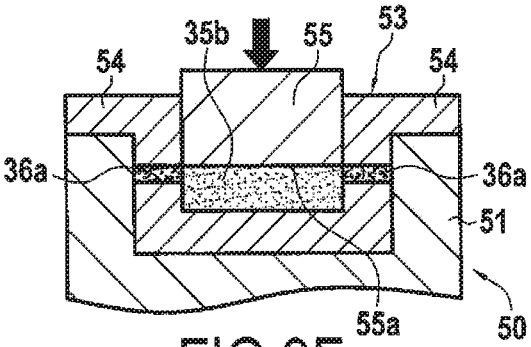

As shown in FIG. 3F, the mold 50 is then closed by fitting its cover portion 53 on its main portion 51. The stationary portions 54 of the cover are designed to cover and press against the first portion 36*a* of the abradable coating as obtained previously. The movable portion 55 of the cover possesses a front bearing surface 55*a*, which is rectilinear in the axial plane of FIG. 3F and circularly arcuate in a radial plane, that faces the second portion 34 of the substrate 32 so that it then presses against the top surface of the powder layer of the second precursor material 35*b*. This powder layer of the second precursor material 35*b* is enclosed in the space defined by the groove 31 in the substrate, by the flanks of the first coating portion 36*a*, by the side surfaces of the stationary portions 54 of the cover 53 of the mold 50, and by the bearing surface 55*a* of the movable portion 55 of the cover 53 of the mold 50.

Stress is then exerted on the movable portion 55 of the cover 53 of the mold 50 in order to bear against the powder layer 35*b* and compress it between the substrate 32 and the bearing surface 55*a* of the cover 53 of the mold 50. The powder layer 35*b* is thus compressed in this way until its thickness is reduced to 7 mm. In this example, the level of the surface of the powder layer 35*b* is then flush with the level of the surface of the first coating portion 36*a*.

During this compression step, the powder particles of the second precursor material 35*b* are compacted against one another, thereby filling in certain voids initially present between the particles, with the air that is expelled in this way being discharged from the mold 50. The porosity of the powder thus decreases during this compression step, and the density of the powder increases, however not as much as for the first precursor material 35*a*.

Figure 3G:
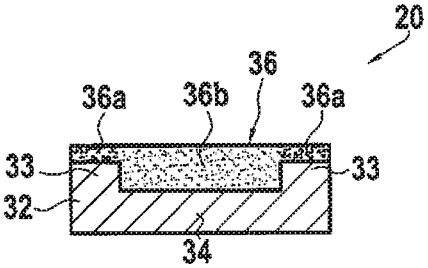

Once such a compressed state has been obtained, the powder layer 35*b* as compressed in this way is sintered using a conventional method. At the end of this sintering step, the abradable track 20 of FIG. 3G is thus obtained in which the substrate 32 is covered by a coating 36 comprising a first portion 36*a* overlying the shoulders 33 and possessing a thickness of 2 mm with porosity of 6%, and a second portion 36*b* overlying the second substrate portion 34, possessing a thickness of 7 mm and porosity of 40.6%.

Naturally, the depth of the groove 31 (which may potentially be zero), the materials 35*a* and 35*b* that are used, the initial thicknesses of the powder layers 35*a* and 35*b*, and the amplitudes of the compressions applied may be adjusted freely in order to achieve desired densities and thicknesses for the coating.

In a second example, shown in FIGS. 4A to 4E, the method includes additional steps that take place after making the first coating portion 136*a* and before making the second coating portion 136*b*, seeking to form a backing layer 137 of high density, e.g. presenting porosity of about 6%, on the second portion 134 of the substrate and under the second coating portion 136*b*.

The method begins in the same manner as in the above example with making a high density first coating portion 136*a*. These steps are therefore not described again.

Figure 4A:
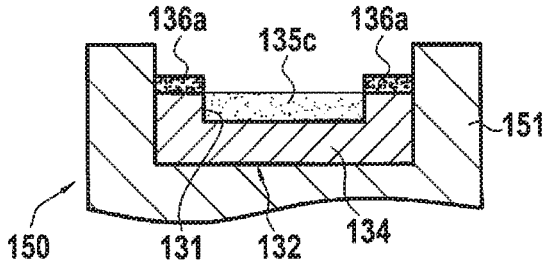
FIGS. 4A to 4E show various successive steps in an example method of the invention.

After these steps, and as shown in FIG. 4A, the substrate 132 is transferred into a mold 150 analogous to the second mold 50 of the first example.

A third precursor material 135*c* is then deposited in the groove 131, i.e. on the second portion 34 of the substrate 32, so as to form a continuous layer of constant thickness over the second portion 34 of the substrate 32. In the present example, the third precursor material 135*c* is identical to the first precursor material used for making the first coating portion 136*a*; in addition, this layer possesses a thickness of 10 mm and initial porosity of about 30%.

Figure 4B:
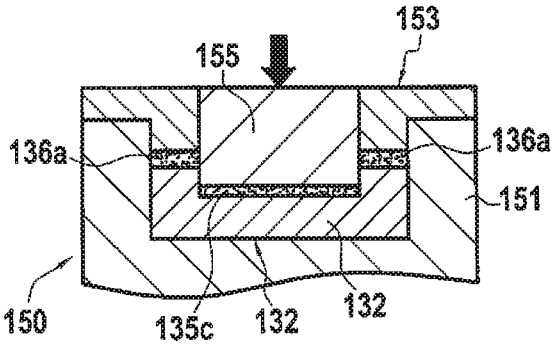

As shown in FIG. 4B, the mold 150 is then closed and stress is then exerted on the movable portion 155 of the cover 153 of the mold 50 in order to compress the powder layer 135*c* between the substrate 32 and the bearing surface of the cover 153 of the mold 150 until its thickness is reduced to 2 mm. Once such a compressed state has been obtained, the powder layer 135*c* as compressed in this way is sintered using a conventional method.

At the end of this sintering step, a backing layer 137 is then obtained covering the second portion 134 of the substrate 132, and possessing a thickness of 2 mm with porosity of 6%.

Figure 4C:
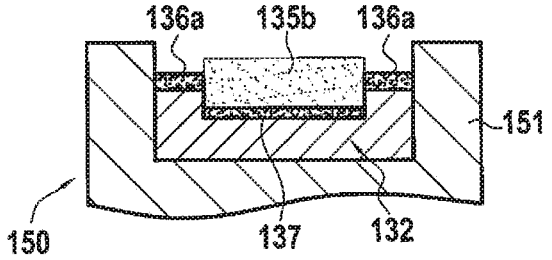
Figure 4D:
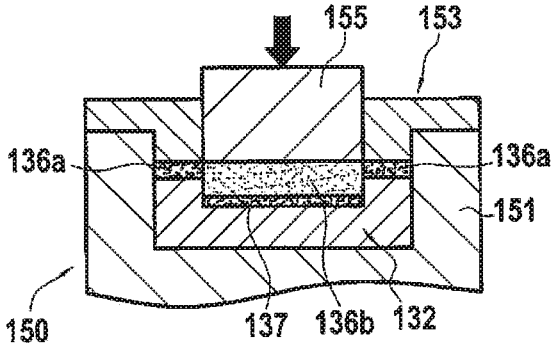

As shown in FIGS. 4C to 4D, the method then continues in analogous manner to the first example, except that the second precursor material 135*b* is deposited on the backing layer 137.

Figure 4E:
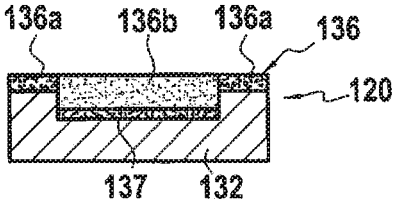

At the end of the method, an abradable track 120 as shown in FIG. 4E is thus obtained in which the second coating portion 136 of lower density covers the backing layer 137, which backing layer protects the substrate 132 in the event of a radial offset of the body traveling past the coating that is greater than the maximum intended offset, e.g. in the event of a large unbalance of the moving body.

In a third example, which is compatible with the first and second examples and is shown in FIGS. 5A to 5E, the method includes additional steps that take place immediately after making the second coating portion 236*b* for the purpose of forming a surface layer 238 of high density, e.g. possessing porosity of 15%, on the second coating portion 236*b* and/or on the first coating portion 236*a*.

The method begins in the same manner as in the first example by making a high density first coating portion 236*a* and a low density second coating portion 236*b*. These steps are therefore not described again.

Figure 5A:
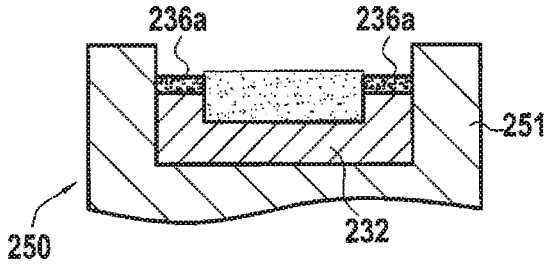
FIGS. 5A to 5E show various successive steps in an example method of the invention.
Figure 5B:
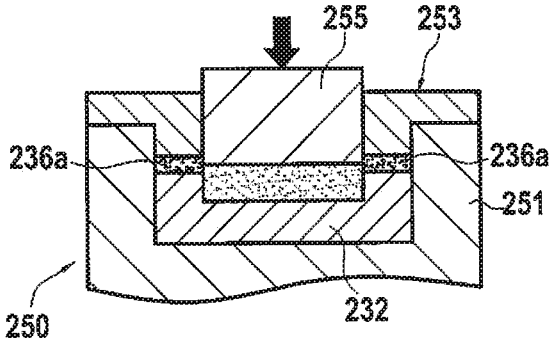

Nevertheless, it should be observed in FIGS. 5A and 5B that the thicknesses of the layer of the second precursor material 235*b* in its initial state and in its compressed state may optionally be modified, i.e. reduced, so as to leave sufficient room at the surface of the second coating portion 236*b* to receive the surface layer 238 when it is desired for that layer to be flush with the first coating portion 236*a*.

Figure 5C:
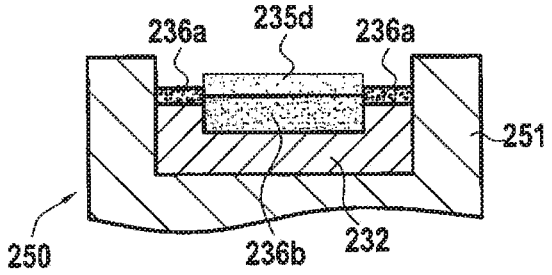

At the end of these steps, and as shown in FIG. 5C, a fourth precursor material 235*d* is deposited on the second coating portion 236*b* as made in this way so as to form a continuous layer of constant thickness. In the present example, the fourth precursor material 235*d* is identical to the second precursor material used for making the second coating portion 236*b*; in addition, this layer possesses thickness of 0.6 mm and initial porosity of about 70%.

Figure 5D:
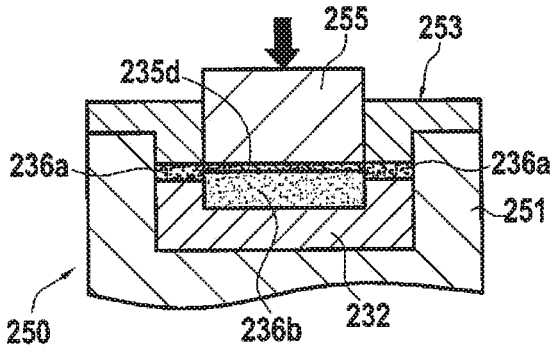

As shown in FIG. 5D, the mold 250 is then closed and stress is then exerted on the movable portion 255 of the cover 253 of the mold 250 in order to compress the powder layer 235*d* between the second coating portion 236*b* and the bearing surface of the cover 153 of the mold 150 until its thickness is reduced to 0.10 mm. Once such a compressed state has been obtained, the layer of powder 235*d* as compressed in this way is sintered using a conventional method.

Figure 5E:
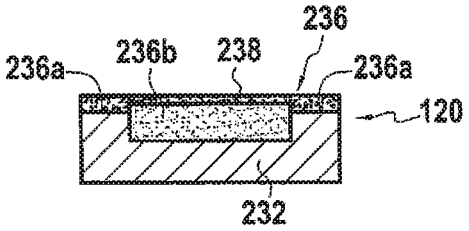

At the end of the method, the abradable track 220 of FIG. 5E is then obtained, in which the second coating portion 236*b* of lower density is covered by a surface layer 238 that is flush with the first coating portion 236*b* and that possesses a thickness of 0.10 mm and porosity of 11.9%. This surface layer 238 possesses less surface roughness than the second coating portion 236*b*, and thus provides an improvement in terms of aerodynamic friction.

The examples described in the present disclosure are given by way of non-limiting illustration, and a person skilled in the art can easily, in the light of this disclosure, modify these examples or envisage others, while remaining within the scope of the invention.

Furthermore, the various characteristics of these embodiment or implementation examples may be used singly or combined with one another. When they are combined, the characteristics may be combined as described above or in other ways, the invention not being limited to the specific combinations described in the present disclosure. In particular, unless specified to the contrary, any characteristic described with reference to any one embodiment or implementation may be applied in analogous manner to any other embodiment or implementation.

The invention claimed is:

1. A fabrication method for fabricating an abradable coating of varying density, the method comprising the following steps:

providing a ring-shaped substrate having a first portion and a second portion;

depositing a first precursor material on the first portion of the substrate;

compressing the first precursor material between the substrate and a first bearing surface;

sintering the first precursor material as compressed in this way in order to obtain a first abradable coating portion having a first inner radial surface on the first portion of the substrate, and possessing a first density;

depositing a second precursor material on the second portion of the substrate;

compressing the second precursor material between the substrate and a second bearing surface; and sintering the second precursor material as compressed in this way in order to obtain a second abradable coating portion having a second inner radial surface on the second portion of the substrate, and possessing a second density distinct from the first density, wherein after sintering the first precursor material and the second precursor material, the first and second inner radial surfaces of the first and second abradable coating portions are exposed to an environment, wherein the step of sintering the first precursor material is performed within a first mold and the step of sintering the second precursor material is performed within a second mold having a shape that is different than a shape of the first mold.

2. A method according to claim 1, wherein the steps of compressing and sintering the first precursor material are performed within the first mold; and wherein the first mold includes the first bearing surface together with at least one protection wall provided so as to extend inward of the first precursor material at an interface between the first and second portions of the substrate during the steps of compressing and sintering the first precursor material.

3. A method according to claim 1, wherein the steps of compressing and sintering the second precursor material are performed within the second mold; and wherein the second mold includes a movable portion extending facing the second portion of the substrate and including the second bearing surface, and a stationary portion extending facing and covering the first portion of the substrate.

4. A method according to claim 1, wherein the first portion of the abradable coating possesses final porosity of less than 15%.

5. A method according to claim 1, wherein the second portion of the abradable coating possesses final porosity greater than 20%.

6. A method according to claim 1, further comprising, prior to the step of depositing the precursor material on one of the portions of the substrate, a step of forming a backing layer by sintering on the portion under consideration of the substrate, the backing layer having final porosity of less than 15%.

7. A method according to claim 1, further comprising, after the step of sintering one of the precursor materials, a step of forming a surface layer by sintering on at least one of the portions of the abradable coating, the surface layer having final porosity of less than 15%.

8. A method according to claim 1, wherein the first precursor material is a powder of grain size less than 20 μm; and wherein the second precursor material is a powder of grain size lying in the range 45 μm to 100 μm.

9. A method according to claim 1, wherein the substrate is a ring sector.

10. A method according to claim 1, wherein the steps of depositing the second precursor material, compressing the second precursor material, and sintering the second precursor material take place after the steps of depositing the first precursor material, compressing the first precursor material, and sintering the first precursor material.

11. A method according to claim 1, wherein the first and second precursor materials are different materials.

12. A method according to claim 1, wherein the first precursor material is a powder of grain size less than 20 micrometers, and wherein the second precursor material is a powder of grain size greater than 45 micrometers.

13. A method according to claim 1, wherein the first abradable coating portion overlaps the second abradable coating portion, at least partially, along an axial direction that is perpendicular to a radial direction defined by the substrate.

14. A method according to claim 13, wherein the first abradable coating portion is positioned farther away from an axial center of the substrate as compared to the second abradable coating portion, along the axial direction.

* * * * *